United States Patent [19]

Martinez, Jr.

[11] 4,201,062

[45] May 6, 1980

[54] METHOD AND APPARATUS FOR CONSERVING ENERGY IN AN AIR CONDITIONING SYSTEM

[76] Inventor: George Martinez, Jr., P.O. Box 1141, Gonzales, La. 70737

[21] Appl. No.: 928,537

[22] Filed: Jul. 27, 1978

[51] Int. Cl.[2] ..... F25B 5/00; F28D 5/00; F25B 1/00

[52] U.S. Cl. ..... 62/117; 62/305; 62/310; 62/498

[58] Field of Search ..... 62/181, 238 E, 79, 115, 62/117, 119, 504, 506, 525, 305, 310, DIG. 2, 218, 219, 174

[56] References Cited

U.S. PATENT DOCUMENTS

| | | | |
|---|---|---|---|
| 2,620,635 | 12/1952 | Mautner et al. | 62/305 |
| 2,718,766 | 9/1955 | Impertore et al. | 62/117 |
| 3,130,557 | 4/1964 | McFarlan | 62/305 |
| 3,191,396 | 6/1965 | Ruddock | 62/115 |
| 3,242,689 | 3/1966 | Chubb et al. | 62/498 |
| 3,412,569 | 11/1968 | Arledge, Jr. | 62/115 |
| 3,435,631 | 4/1969 | Wood, Jr. | 62/305 |
| 3,744,264 | 7/1973 | Ware | 62/119 |
| 3,744,273 | 7/1973 | Ware | 62/115 |
| 3,995,443 | 12/1976 | Iversen | 62/305 |
| 4,102,392 | 7/1978 | Schneider | 62/300 |
| 4,144,722 | 3/1979 | Mattwell | 62/305 |

*Primary Examiner*—Lloyd L. King

*Attorney, Agent, or Firm*—David L. Ray; Edgar E. Spielman, Jr.

[57] ABSTRACT

A method and apparatus for conserving energy in the operation of a conventional air conditioning system in a large building employing a refrigerant evaporator, a water cooled refrigerant condenser, a refrigerant compressor, and a cooling tower, wherein the compressor is not energized, the condenser and evaporator are flooded with refrigerant from a reservoir, and the refrigerant from the reservoir is circulated between the condenser and the evaporator while the cooling tower is in operation.

8 Claims, 2 Drawing Figures

METHOD AND APPARATUS FOR CONSERVING ENERGY IN AN AIR CONDITIONING SYSTEM

BACKGROUND OF THE INVENTION

The present invention relates to a refrigeration and air conditioning system. In particular, the invention relates to a method and apparatus for saving energy in the operation of a large building air conditioning system.

In large, multi-story buildings air conditioning systems are designed to promote year-round cooling. This characteristic is essential to a cooling system designed for buildings in which the outer peripheral surfaces and areas are subject to wide temperature gradients whereas the inner portions remain relatively stable regardless of the ambient conditions. Such an air conditioning system must, in general, be operated for substantially the entire year to provide the necessary cooling and air circulation. During the mild and cold weather months of the year the system can be operated without the compressor where ambient conditions permit.

Various methods and apparatuses are disclosed in the art for minimizing the time that is necessary to run a compressor. See, for example, U.S. Pat. Nos. 2,718,766; 3,191,396; 3,242,689; 3,412,569; and 3,744,264.

When the system is run without the compressor, significant amounts of energy are saved because a compressor consumes large amounts of energy when it is operated. Therefore, to reduce the amount of energy consumed by the air conditioning system in a building, it is desirable that the time during which the compressor is operated be minimized.

SUMMARY OF THE INVENTION

A method and apparatus for conserving energy in the operation of a conventional air conditioning system in a large building employing a refrigerant evaporator, a water cooled refrigerant condenser, a refrigerant compressor, and a cooling tower, wherein the compressor is not energized, the condenser and evaporator are flooded with refrigerant from a reservoir, and the refrigerant from the reservoir is circulated between the condenser and the evaporator while the cooling tower is in operation.

DESCRIPTION OF THE PREFERRED EMBODIMENTS

Figure 1:
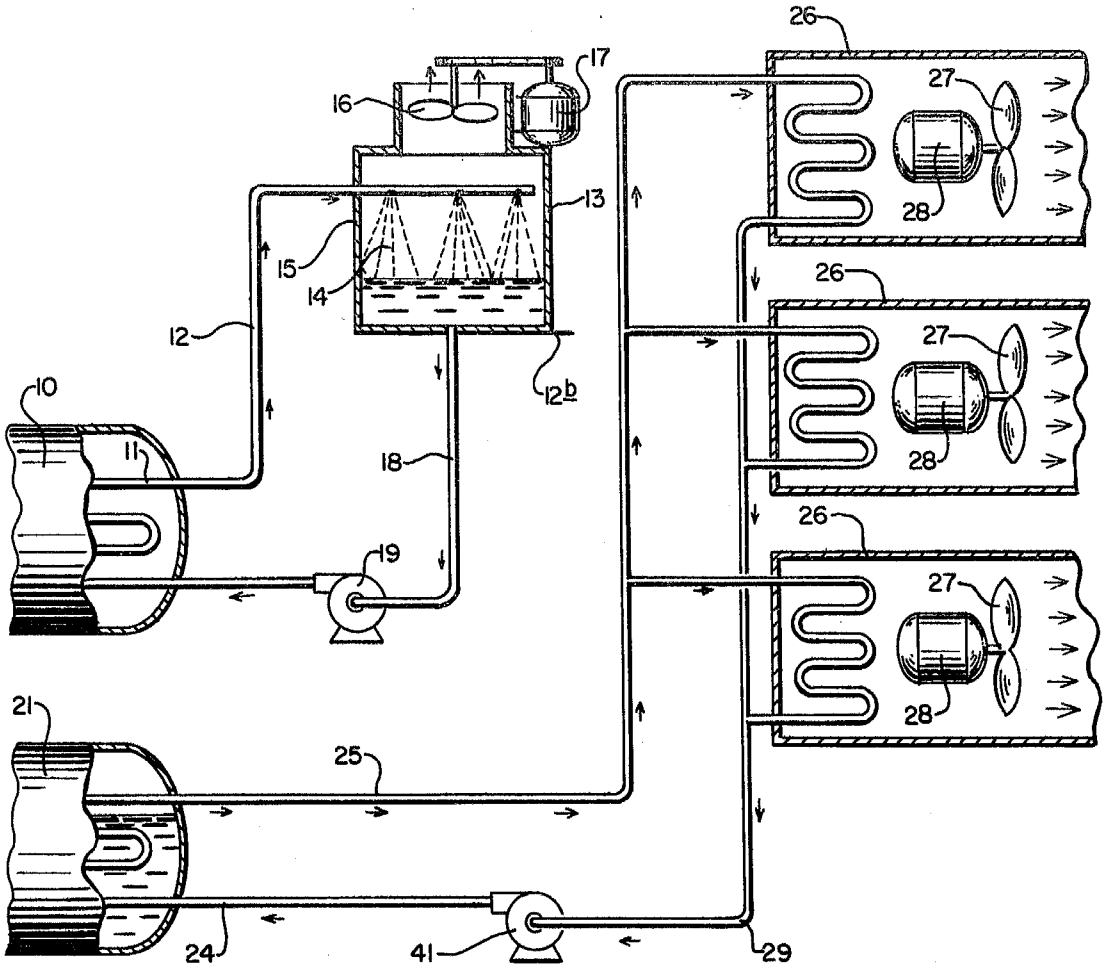
FIG. 1 is a schematic layout of the operation of the usual building air conditioning unit; and, FIG. 2 is a partly-schematic, partly-detailed view of portions of the condenser and cooler embodying additional parts added to the usual building air conditioning unit essential to the operation of the process of the invention.

Referring now to FIG. 1, 10 is the condenser of the usual building air conditioning unit which has a bundle of water tubes 11 running therethrough and which has an outlet pipe 12 running from the connection **12*a* to the roof 12*b* of the building where it connects to the upper end of the cooling tower 13 and it terminates in a series of holes along its bottom edge forming a downward spray 14. The cooling tower 13 has air intake louvers (not shown) in its walls 15 and a suction fan 16 operated by a motor 17 which draws the air upwardly through the spray 14 and out to the open air. The water thus cooled is pumped back through pipe 18 and pump 19 into the bundle of water tubes 11 in the condenser 10 at 18*a*** thereby completing this cycle.

Figure 2:
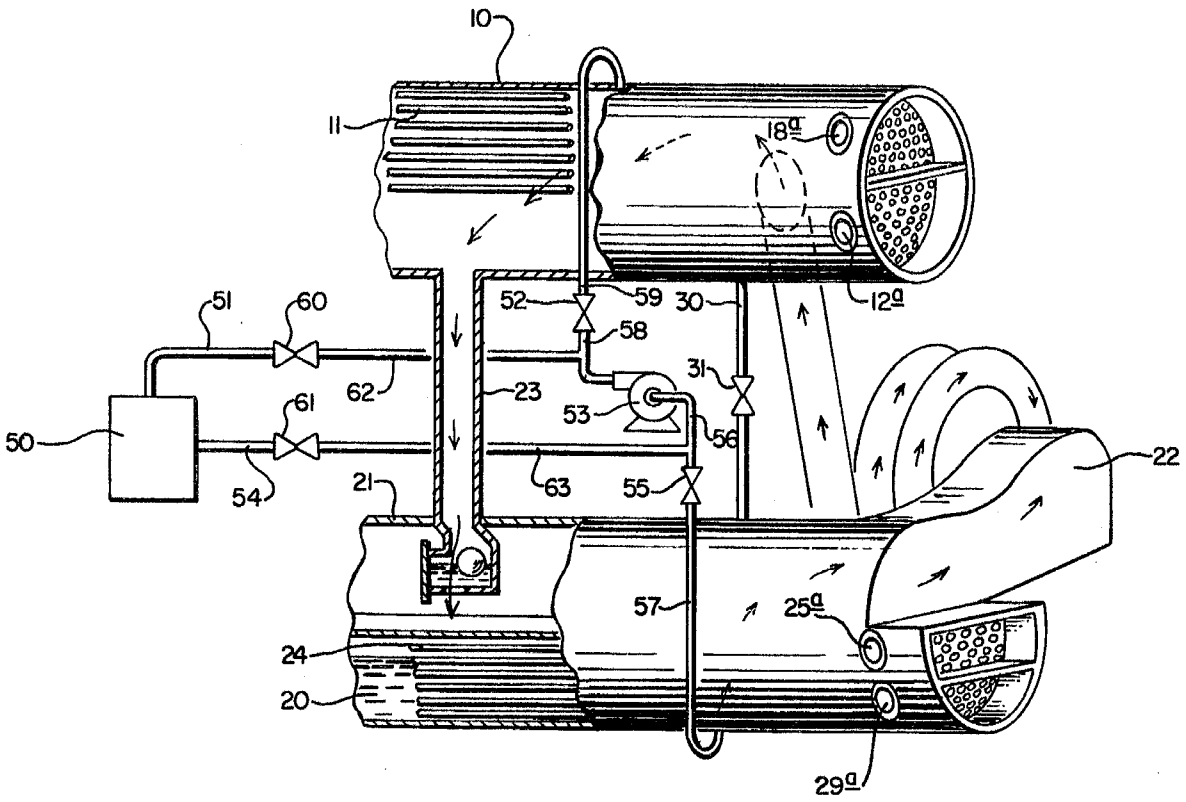

In this way (as shown in FIG. 2) the water in water tubes 11 in the condenser 10 is constantly cooled so as to cool and liquify the vapors of refrigerant 20 passing into condenser 10 from cooler or evaporator 21 through a compressor 22 of usual structure connecting one end of cooler 21 to the adjoining end of condenser 10. The compressor 22 is of usual construction and not shown in detail. The words "cooler" and "evaporator" as used herein both refer to 21.

The cooler 21 is also connected to the condenser 10 by a float trap 23 of usual construction through which the condensed refrigerant can pass in only one direction from the condenser 10 into the cooler 21. A bundle of chill water tubes 24 are mounted in the lower half of cooler 21 so as to run its entire length and they are covered by refrigerant 20 which fills only the lower half of cooler 21. These tubes 24 carrying the chilled water leave the cooler 21 at **25*a* into pipes 25 and pass in parallel through the room cooling units 26 equipped with fans 27 driven by motors 28 and returned by pipes 29 through pump 41 and connection 29*a* into cooler 21**, thereby completing the cycle.

An equalizer 30 controlled by valve 31 connects the cooler 21 to the condenser 10 and may be used in the usual building air conditioning system as desired.

The foregoing describes the usual structure as found in the great majority of building air conditioning units.

The operation of this usual building air conditioning unit during light, ordinary, or heavy load conditions is generally the same. In order to secure sufficient chilling of the water circulated from the cooler 21 through pipe 25 and cooling units 26, it is necessary to run the compressor 22 to build up pressure and condense the refrigerant 20 vapors from the cooler 21 and thereby liquify said vapors so as to return the vaporized refrigerant 20 in liquid form through float trap 23 to the cooler 21 and by this continuous cycle constantly maintain the temperature in cooler 21 by varying the pressure in cooler 21.

In the present invention, in addition to the usual or regular building air conditioning equipment as hereinbefore described, there is added a pump 53, a refrigerant reservoir 50, four valves 52, 55, 60, and 61, in addition to pipes connecting the pump to the condenser 10 and cooler or evaporator 21 to permit refrigerant to be pumped from cooler 21 into condenser 10 by pump 53. The refrigerant reservoir 50 is used to supply additional amounts of refrigerant to flood the cooler and condenser when the compressor is not operating.

Pump 53 is connected to condenser 10 and cooler 21 by pipes 58 and 59, respectively, which in turn are connected by valve 52 and by pipes 56 and 57, which in turn are connected by valve 55. Refrigerant reservoir 50 is connected to pipe 58 by pipes 51 and 62, which in turn are connected by valve 60, and reservoir 50 is connected to pipe 56 by pipes 54 and 63, which in turn are connected by valve 61.

In carrying out the method of the invention, the cooling tower fan 16, the condenser water pump 19, and the chill water pump 41 are all set into operation, the compressor 22 is de-energized or turned off, and refrigeration is then as follows:

To flood condenser 10 and cooler 21 with refrigerant from reservoir 50, valve 31 is opened, valve 55 is closed, valve 60 is closed, and valves 52 and 61 are opened. Pump 53 is activated to pump refrigerant from reservoir 50 through line 54, valve 61, line 63, line 56, through pump 53, line 58, valve 52, and line 59 into condenser 10. As condenser 10 fills, refrigerant flows downwardly through line 30 and valve 31 into cooler 21. Some refrigerant may flow downwardly also through float trap 23. Pump 53 continues to run until condenser 10 is approximately filled and water tubes 11 and 24 are covered with liquid refrigerant. When this condition is reached, valve 61 is closed, valve 60 remains closed, and valve 55 is opened. Pump 53 then continuously circulates refrigerant from the bottom of cooler 21 upwardly to the top of condenser 10. Since the cooling water fan and the condenser water pump 19 are in operation, the water tubes 11 in condenser 10 are cooled by the cooling tower and thus cool the refrigerant 20 which is being circulated around tubes 11. As refrigerant 20 is circulated around tubes 11 and flows downwardly through line 30, it also cools tubes 24. Thus, water flowing through tubes 24 is cooled and travels to cooling units 26 to affect cooling of the building without operation of the compressor.

To return the system to the normal cycle wherein the compressor 22 is activated, the excess refrigerant in the evaporator 21 and condenser 10 must be returned to the reservoir 50. To return the excess refrigerant to reservoir 50, valves 52 and 61 are closed, valves 60, 55, and 31 are opened, and pump 53 is run until the desired amount of refrigerant is returned to the reservoir. Valves 60, 55, and 31 are then closed, valves 52 and 61 remain closed, compressor 22 is activated, and the system is then operating in the normal cycle. Conventional automatic controls can be utilized to operate the system, or the system can be operated manually.

The invention provides an important advantage when the system is being repaired. Reservoir 50 may be utilized to receive all of the refrigerant in the system prior to disassembly.

As is known to those skilled in the art, some air conditioning systems substitute a nozzle arrangement for the float assembly 23 whereby refrigerant is injected into a circuit of tubes in the evaporator, rather than injecting the refrigerant into the body of the evaporator shell. Vaporous refrigerant is removed from the tubes in the evaporator by the compressor 22. The chill water is in turn injected into the body of the evaporator shell. The present invention is applicable to such a nozzle arrangement as would be obvious to those skilled in the art.

Also, as is known to those skilled in the art, rather than using a shell and tube arrangement, a tube-in-tube arrangement can be utilized to effect heat transfer between the refrigerant and the water circuit. The present invention is applicable to such a tube-in-tube arrangement as would be obvious to those skilled in the art.

It will be understood that any recognized source of cold water, or any other conventional cooling source, may be used instead of the cooling tower 13 such as cold well water as is generally used in installations where it is available. A cold well water source will increase the heat transfer rate between the refrigerant 20 and the chill water and tube bundle 24 sufficiently to obtain the required temperature of the chilled water.

An equalizer tube 30, if not in the unit as installed, must also be added with the shut-off valve 31 which must be closed when compressor 22 is in use. This equalizer 30 will allow a free passage of the refrigerant 20 in the cooler 21 and the condenser 10 in installations where such brief passages otherwise are restricted.

Variations may be made in the process and apparatus of the invention without departing from the scope and intent of the same and such variations are covered by the scope of the specification, drawings, and claims herein.

What is claimed:

1. An air conditioning system comprising:

a. condenser means;

b. evaporator means;

c. cooling source means;

d. compressor means for conveying vaporous refrigerant from said evaporator means to said condenser means;

e. means for conveying liquid refrigerant from said condenser means to said evaporator means;

f. first liquid circuit means for circulating liquids between said evaporator means and said cooling unit means;

g. second liquid circuit means for circulating liquids between said condenser means and said cooling source means;

h. reservoir means for containing refrigerant;

i. means for transferring liquid refrigerant from said reservoir means to said condenser means and said evaporator means to fill both said condenser means and said evaporator means with liquid refrigerant; and, j. pump means for circulating said liquid refrigerant between said condenser means and said evaporator means after said condenser means and said evaporator means have been filled.

2. The air conditioning system of claim 1 wherein said first liquid circuit means comprises pipe means partially contained in said evaporator means and in said cooling unit means located in the area to be cooled, said pipe means being adapted for conveying a liquid medium to be cooled between said evaporator means and said cooling unit means, said liquid medium being heated in said cooling unit means and cooled in said evaporator means.

3. The air conditioning system of claim 1 wherein said second liquid circuit means comprises pipe means partially contained in said condenser means and in said cooling tower means located in the area to be cooled, said pipe means being adapted for conveying a liquid medium to be cooled between said condenser means and said cooling tower means, said liquid medium being heated in said cooling tower means and cooled in said condenser means.

4. The air conditioning system of claim 1 wherein said cooling source means comprises cooling tower means.

5. A method for conserving energy in an air conditioning system having condenser means, evaporator means, cooling source means, cooling unit means, first liquid circuit means for circulating liquids between said evaporator mears and said cooling unit means, second liquid circuit means for circulating liquids between said condenser means and said cooling source means, means for conveying liquid refrigerant from said condenser means to said evaporator means, and means for conveying vaporous refrigerant from said evaporator means to said condenser means comprising:

a. de-energizing said means for conveying vaporous refrigerant from said evaporator means to said condenser means;

b. substantially filling said condenser means and said evaporator means with liquid refrigerant;

c. circulating said liquid refrigerant between said evaporator means and said condenser means; and, d. circulating liquids through said second liquid circuit means to transfer heat from said condenser means.

6. The air conditioning system of claim 5 wherein said means for conveying refrigerant from said evaporator means to said condenser means comprises compressor means.

7. The air conditioning system of claim 5 wherein said means for circulating refrigerant between said evaporator means and said condenser means comprises pump means.

8. The method of claim 5 wherein said cooling source means comprises cooling tower means.

* * * * *